US010354565B2

(12) United States Patent
Salazar Rodriguez

(10) Patent No.: US 10,354,565 B2
(45) Date of Patent: Jul. 16, 2019

(54) OUTDOOR ADVERTISING STRUCTURE WITH A TILTING, LOWERABLE SCREEN

(71) Applicant: Oscar Javier Salazar Rodriguez, Nuevo Leon (MX)

(72) Inventor: Oscar Javier Salazar Rodriguez, Nuevo Leon (MX)

( * ) Notice: Subject to any disclaimer, the term of this patent is extended or adjusted under 35 U.S.C. 154(b) by 0 days.

(21) Appl. No.: 15/027,251

(22) PCT Filed: Oct. 2, 2014

(86) PCT No.: PCT/MX2014/000156

§ 371 (c)(1),
(2) Date: Apr. 18, 2016

(87) PCT Pub. No.: WO2015/057044

PCT Pub. Date: Apr. 23, 2015

(65) Prior Publication Data

US 2016/0247424 A1 Aug. 25, 2016

(30) Foreign Application Priority Data

Oct. 17, 2013 (MX) ..... MX/a/2013/012114

(51) Int. Cl.
*G09F 15/00* (2006.01)

(52) U.S. Cl.
CPC ..... *G09F 15/0087* (2013.01); *G09F 15/0025* (2013.01); *G09F 15/0037* (2013.01)

(58) Field of Classification Search
CPC ..... G09F 15/0087; G09F 2017/0025
(Continued)

(56) References Cited

U.S. PATENT DOCUMENTS 3,579,880 A * 5/1971 Murphy ..... G09F 7/02 40/473
3,958,349 A * 5/1976 Nidelkoff ..... G09F 7/20 248/333

(Continued)

FOREIGN PATENT DOCUMENTS

DE 202010004464 U 7/2010
EP 2105907 A2 9/2009

(Continued)

*Primary Examiner* — Joanne Silbermann
(74) *Attorney, Agent, or Firm* — Young & Thompson

(57) ABSTRACT

The invention relates to an outdoor advertising structure with a tilting, lowerable screen, formed by a pedestal and a screen whereon the advertisement is placed, and which does not put up resistance to the passage of wind. The invention has a mechanism that allows the screen to tilt during strong winds and to return to the vertical position when the wind stops or loses strength. It also has a mechanism that allows the advertising material exhibited on the screen to be constantly and uniformly held taut, especially when said advertising material is made of a type of canvas or similar material. The pedestal is formed by two tubes of different diameters, which, by means of a lifting mechanism, allow the upper screen to be lowered in order to replace the exhibited advertisement, or to carry out repairs and/or maintenance. The invention reduces to minimum accidents that occur when carrying out any intervention, as well as the likelihood of the structure collapsing. It also reduces costs relating to materials, production, cranes, transportation, lying of foundations and maintenance. The invention also reduces the amount of graffiti and undoubtedly improves the aesthetics of the urban landscape.

6 Claims, 14 Drawing Sheets

Figure 1:
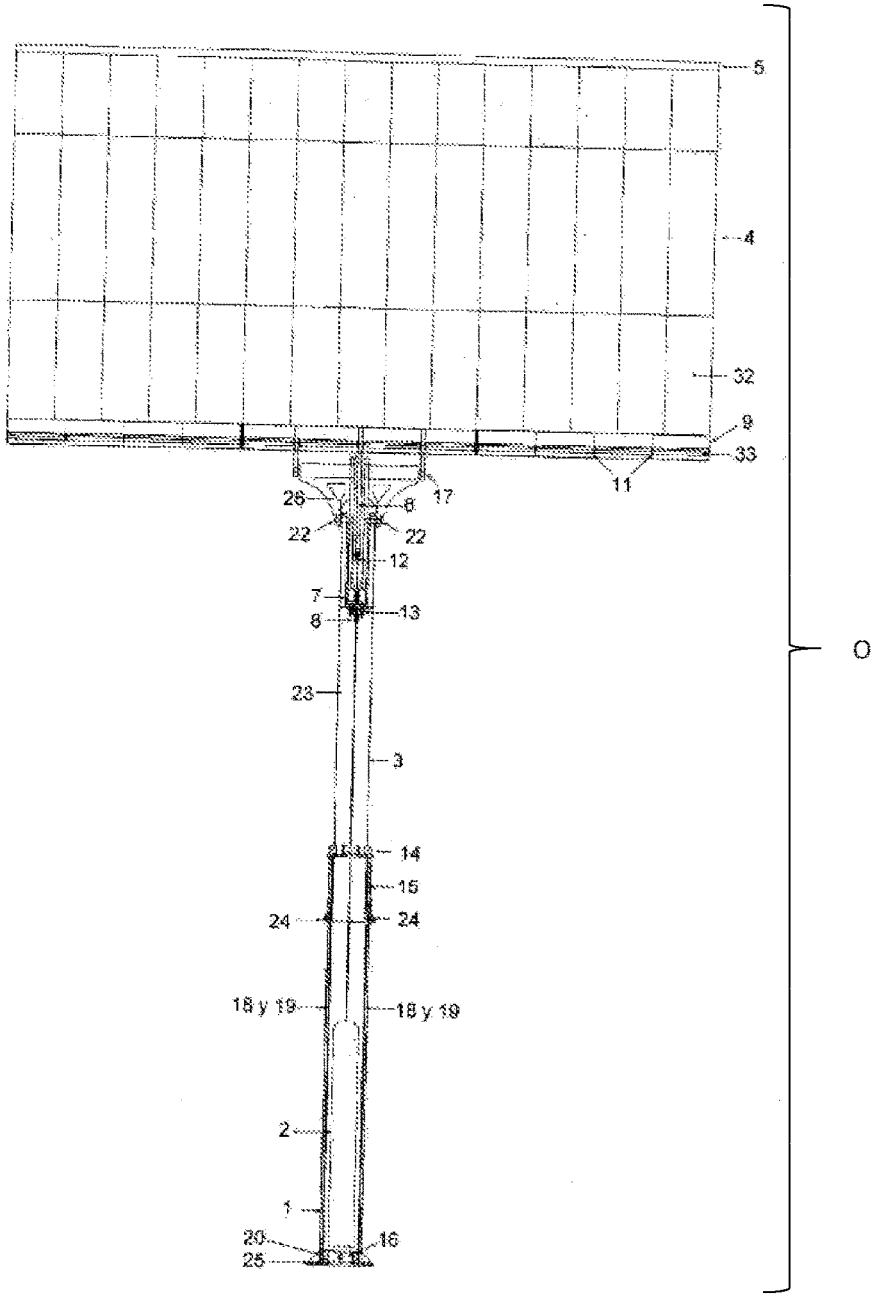

(58) Field of Classification Search
USPC ..... 40/601, 606.14, 606.15, 624
See application file for complete search history.

(56) References Cited

U.S. PATENT DOCUMENTS

| | | | | |
|---|---|---|---|---|
| 4,481,729 | A * | 11/1984 | Weiller | G09F 15/0006 40/584 |
| 5,542,203 | A * | 8/1996 | Luoma | G09F 13/04 340/908 |
| 6,750,829 | B2 * | 6/2004 | Luoma | G06F 3/147 345/1.1 |
| 7,128,127 | B1 * | 10/2006 | Love | A47F 7/163 160/335 |
| 2009/0235565 | A1 * | 9/2009 | Waas | G09F 15/0081 40/541 |
| 2010/0018097 | A1 | 1/2010 | Xu | |
| 2012/0186118 | A1 | 7/2012 | Nabors, Jr. | |

FOREIGN PATENT DOCUMENTS

| | | | |
|---|---|---|---|
| WO | 9114253 | A2 | 9/1991 |
| WO | 9425952 | A1 | 11/1994 |
| WO | 2007148962 | A2 | 12/2007 |

* cited by examiner

Fig.8-A

OUTDOOR ADVERTISING STRUCTURE WITH A TILTING, LOWERABLE SCREEN

This invention consists of an outdoor advertising structure with a tilting, lowerable screen, which does not put up resistance to the passage of wind. Formed by at least one pedestal and at least one screen whereon the advertisement is placed, on one or both sides of the screen. It counts on a mechanism that allows the upper screen to tilt during strong winds and go back to its vertical position as soon as the wind allows it. In addition, it includes a mechanism to constantly and evenly tighten the advertising materials shown on the screen, especially when using canvas, or similar materials.

The pedestal used as a support is formed by at least two tubes with different diameter and, through a lifting mechanism, the tube with the smaller diameter slides inside the tube with the larger diameter, in a telescopically. It provides the height desired for the structure. This mechanism also allows the upper screen to be lowered up to some centimeters above the ground, in order to replace the advertising materials shown, or to perform reparation and/or maintenance activities.

BACKGROUND

By performing a thorough analysis of outdoor advertising installed on the main avenues and highways of Mexico and the United States, I have found that these advertisements consist of structures that are too robust and expensive, which is justified mainly by the resistance these must have against strong winds, especially during hurricane and cyclone seasons. Usually, this type of advertisements are manufactured in local workshops that offer welding services, where each advertisement, once it is finished, requires a hydraulic crane of great dimensions in order to be placed on a platform and transferred to the place where it shall be installed. A similar crane is required to unload and place the components of the advertisement. Due to the size of these advertisements, it is very hard to move more than one of these structures on one platform, which increases the total cost per unit.

Currently, outdoor advertising materials generally offer two sides and they weight around 8 to 12 tons, which represents a latent risk for the people living or passing by the streets or avenues where these ads are installed. We frequently hear about these advertisements falling down during strong winds in the main cities of the country, with consequences that can be fatal.

The structure proposed herein, which is fully described below, looks just like the structures we can find on avenues and they have very similar dimensions, the difference relies on this structure being able to not putting up resistance against strong winds, which discards potential collapse of the structure. In contrast with the currently used ads, this structure us built with leaner materials and smaller cells which make it much lighter; thus, reducing the cost of materials for its construction, the cost for workforce to build it, the cost for the foundation required for the installation; the cost of the fleet to transfer it, and the cost of the cranes involved in the process to lift it and place it on the platform and to install it. The screen that shows the ad on the upper part is preferably built with aluminum and plastic materials, always offering the option to show ads on both sides. Electronic screens, moving shapes or artifacts can be placed on the screen, as well as devices projecting an image or video on the surface of the screen.

I have paid special attention to the staff in charge of removing and placing the canvas fixed to the screen on the top part of the conventional ads, around 20 meters high. When asking them how risky their job is, they explained the danger this entail, and actually most of them remember some incidents that have had fatal results for their co-workers or incidents that caused permanent disabilities. They mention that just a slip or a simple wire making contact with the power lines are some of the accidents that can lead to fatal consequences.

The invention herein offers the option to lower the upper screen, either to replace the ad, or perform maintenance activities, or to perform repairs. By lowering the screen the accidents and risks the staff is exposed to when performing such activates are significantly reduced.

Any operation related to some component of the structure will be performed, virtually, at ground level, or using small ladders.

It is also quite obvious that the traditional ads lack of an efficient and standardized system to anchor and fix the canvas to the screen, causing installers to use galvanized wire, ropes and plastic straps, which have to be broken and discarded once a new canvas is installed. This definitely extends the canvas installation time, causing an additional expense for these types of consumables, and this does not guarantee and even and constant tightening of the whole surface of the canvas. The lack of tightness on the canvas, as well as the enlarging effect thereof caused by solar heat, leads to looseness and it facilitates the destruction of the canvas by the wind, not to mention the appearance of wrinkles and bending of the canvas, which affects the clarity of the ads shown.

Another important element in our times is urban aesthetics, which is negatively affected by the robustness of this kind of ads placed on main avenues. The resistance these structures must have against strong winds has caused manufacturers to leave aside the visual appearance and the urban image, focusing on reinforcing and strengthening the components of the ad to face the natural phenomena that seem to be more and more frequent in our planet.

The invention herein presents a pedestal formed by at least two tubes whose diameters are smaller than the ones used for these ads, as well as a much leaner screen that the traditional ones, whose profile is narrower on the top part, which makes it lighter, more aerodynamic and, certainly, more aesthetic. This makes this structure an excellent option to reduce the visual pollution caused by the robustness of conventional outdoor advertising.

We have frequently witnessed how problematic it is to deal with graffiti in big cities, and outdoor advertising is no stranger to this situation. The ladders on the sides of the ads and the passageways that can be seen right below the screen located at the top have been used by gangs and vandals to climb to the upper part and paint on top of the ad, mainly with spray paint. This definitely entails a negative image for the product being advertised; it shows the proliferation of this activity to the visitors and tourists, it leads to additional expenses for the owner of the ad as they must replace the damaged ad, and sometimes it damages the commercial relationship between the company that owns the ad and the company that wants to be advertised or is planning to be advertised.

The structure proposed herein does not involve stairs on its pedestal, nor passage ways next to the screen; thus it is virtually impossible for gangs and vandals to climb and walk from side to side of the screen to spray paint the ads shown, the way it happens with traditional ads.

This lead me to design and propose a new outdoor advertisement structure that brings a solution for all negative aspects described in these paragraphs; thus, I am asking for the protection of such invention through the patent request herein. The structure to be patented is described below through several figures that represent some of the preferred execution forms, as an illustration, not a limitation.

SHORT DESCRIPTION OF THE FIGURES

FIG. 1) shows a frontal view of the outdoor advertising structure (0), in which the screen (4) is in a vertical position.

Figure 2:
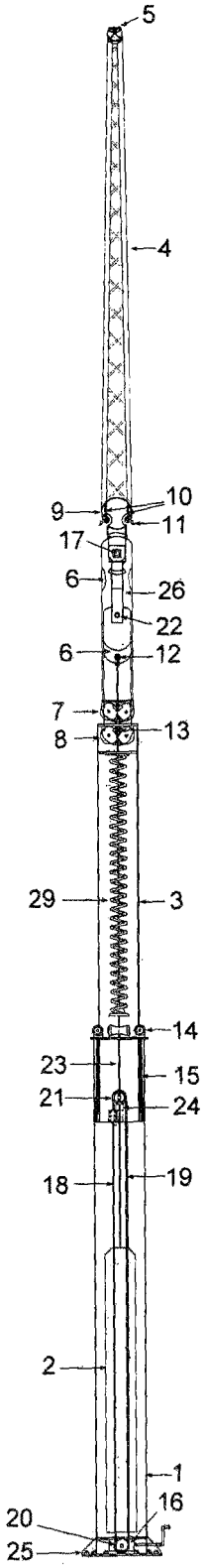

FIG. 2) shows a lateral view of the structure (0) with the screen (4) also in a vertical position.

Figure 3:
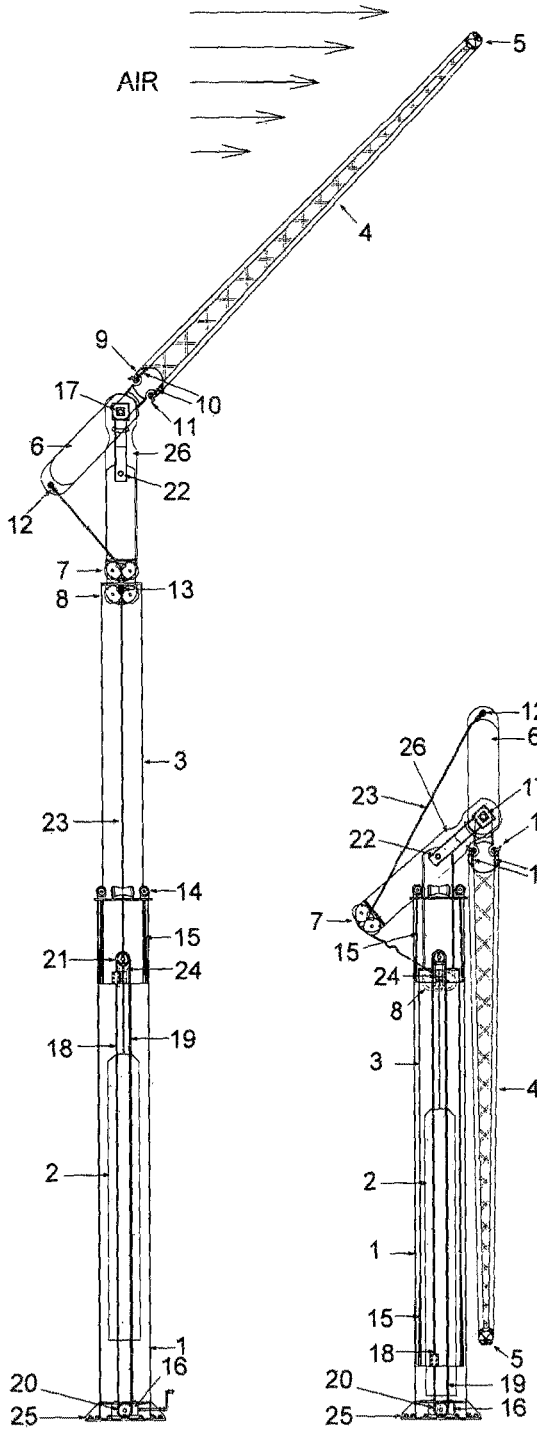

FIG. 3) shows the screen (4) tilting, according to the wind flow.

Figure 4:
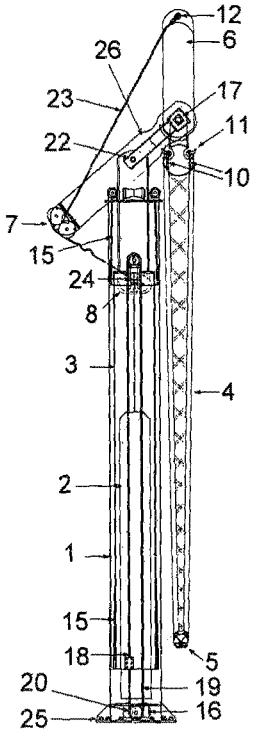

FIG. 4) shows the screen (4) in a retracted position, once it is lowered up to some centimeters above the ground.

Figure 5:
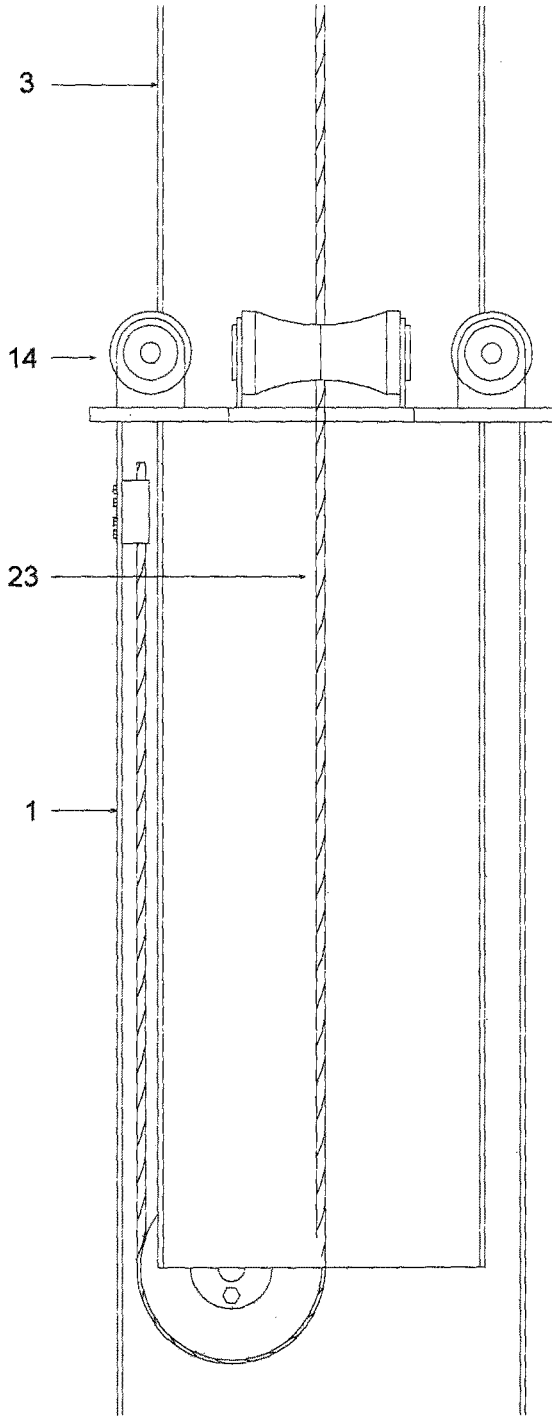

FIG. 5) shows the mechanism that turns the weight of one part of the structure into the counterweight required for tilting the screen (4) and taking it back to its vertical position.

Figure 6:
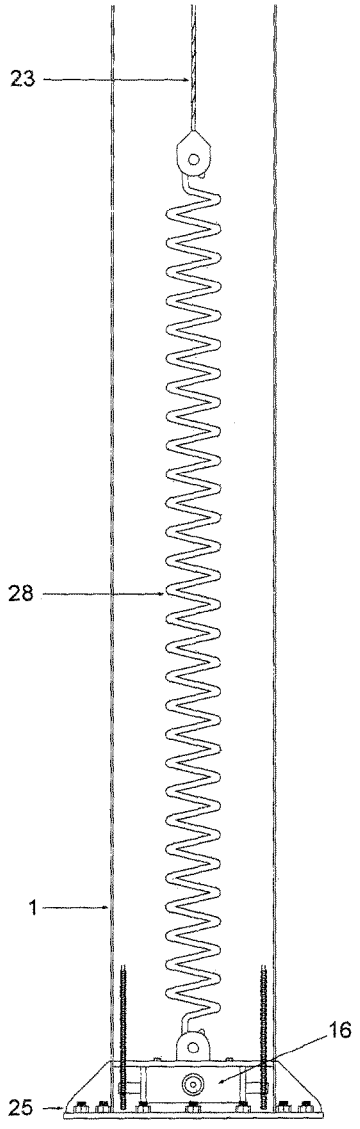

FIG. 6) shows a mechanism that allows the screen (4) to tilt and to go back to its vertical position by using a tightening spring (28) fixed to the foundation of the structure.

Figure 7:
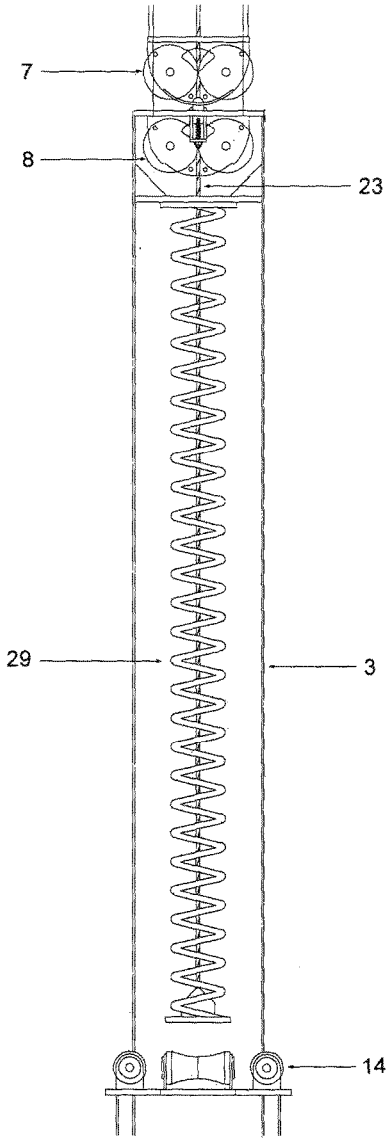

FIG. 7) shows a mechanism that uses a compression spring (29) to allow the screen (4) to tilt and go back to its vertical position.

Figure 8:
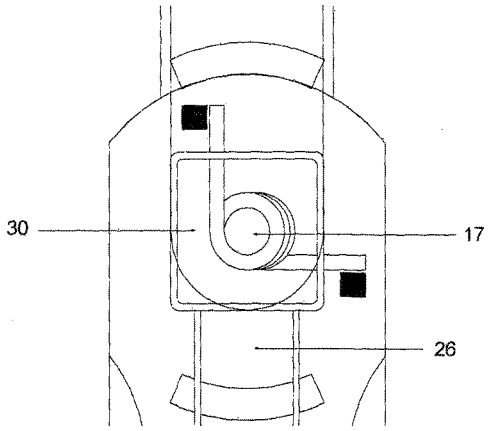

FIGS. 8) and (8-A) show a mechanism that allows the screen (4) to tilt and go back to its original position operating both ways, using two torsion springs (30) installed on shaft 17.

Figure 9:
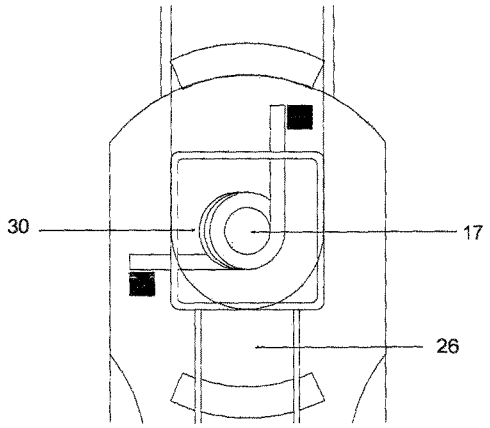
Figure 9:
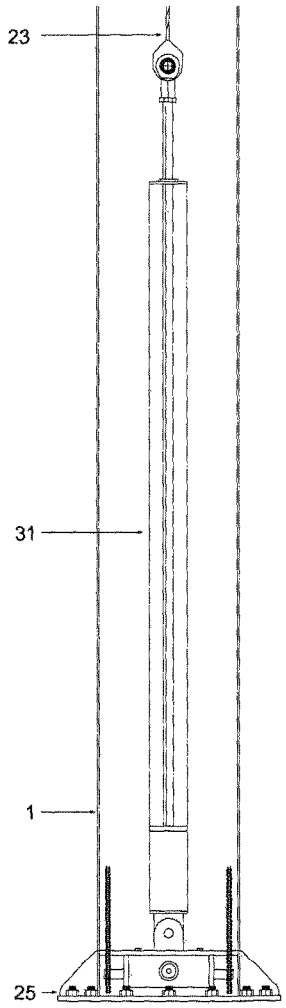

FIG. 9) shows a mechanism that allows the screen (4) to tilt and go back to its vertical position by using a pneumatic piston fixed to the foundation of the structure.

Figure 10:
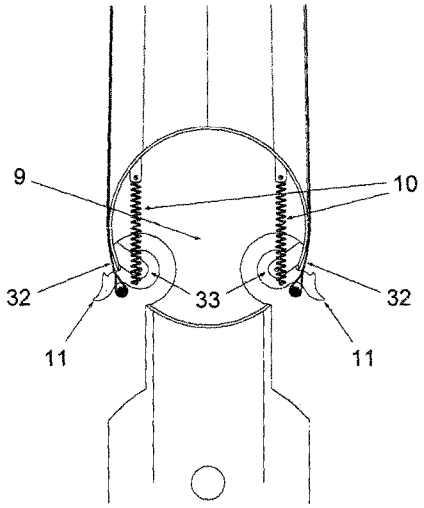

FIG. 10) shows an adjustment mechanism for the advertising material (32) that uses a series of rollers (11) installed along the screen (4), provided with hooks that anchor and keep the advertising material (32) tight by using the strength of the springs (10).

Figure 11:
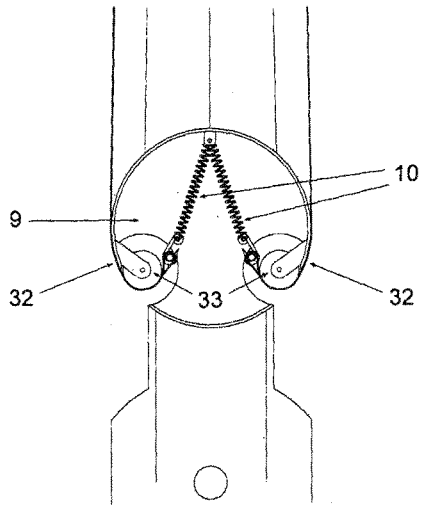

FIG. 11) shows a mechanism that tightens the advertising material (32) by using rollers (11), on which the advertising material (32) is rolled and tightened, fixing it with the hooks found on the springs (10).

Figure 12:
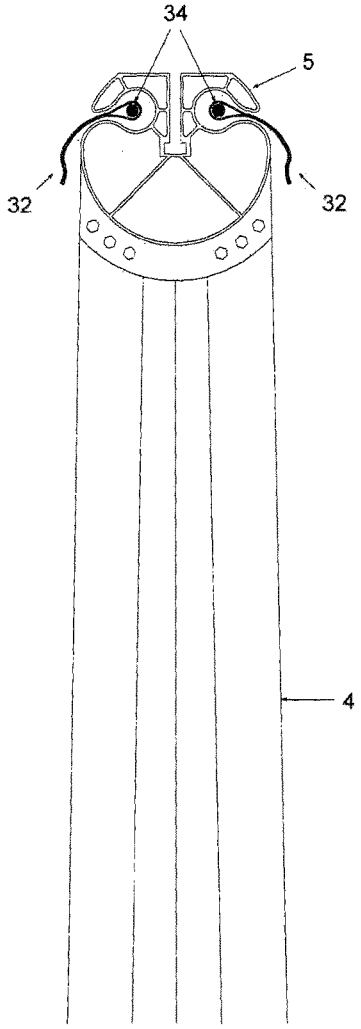

FIG. 12) shows the upper profile (5) of the screen (4) showing two longitudinal notches fixed to the advertising material (32) through the insertion of rods (34).

Figure 13:
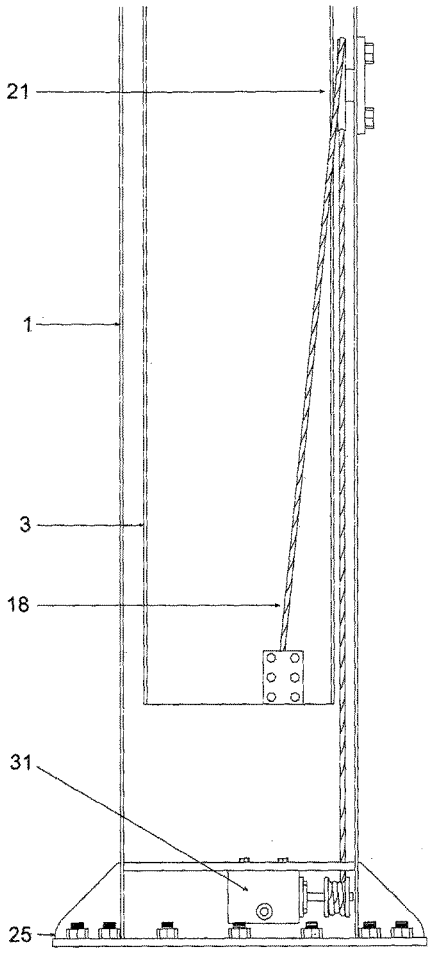

FIG. 13) shows the operation of a winch (31) as a lifting mechanism to move the tube with the smaller diameter (3) through the tube with the bigger diameter.

Figure 14:
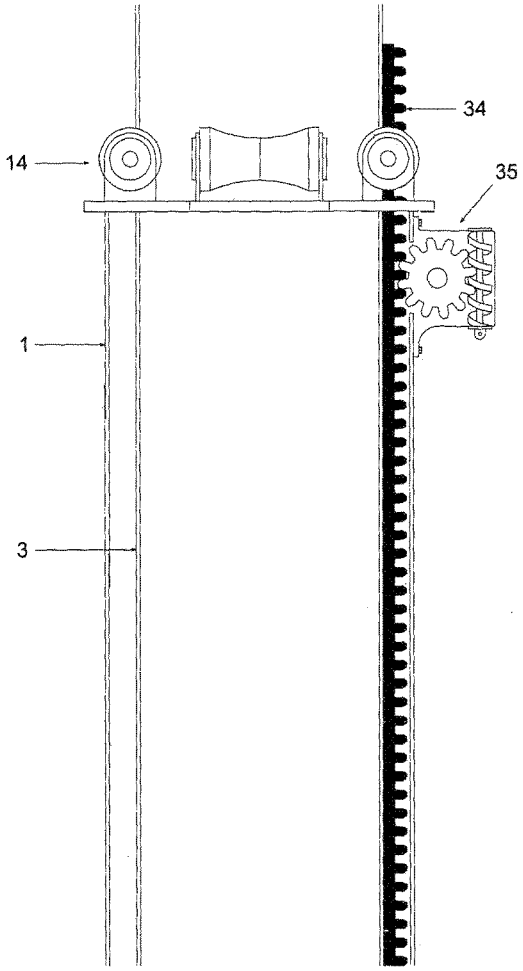

FIG. 14) shows a lifting mechanism that uses a zipper (34) or jagged rod to move the tube with the smaller diameter (3) inside the tube with the bigger diameter (1).

Figure 15:
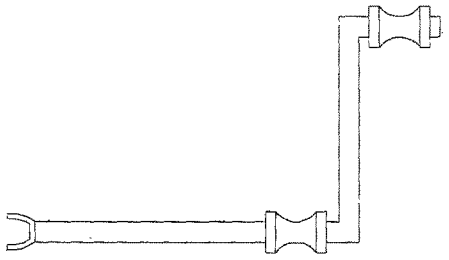

FIG. 15) shows the crank used to operate the motor-reducer (16).

Figure 16:
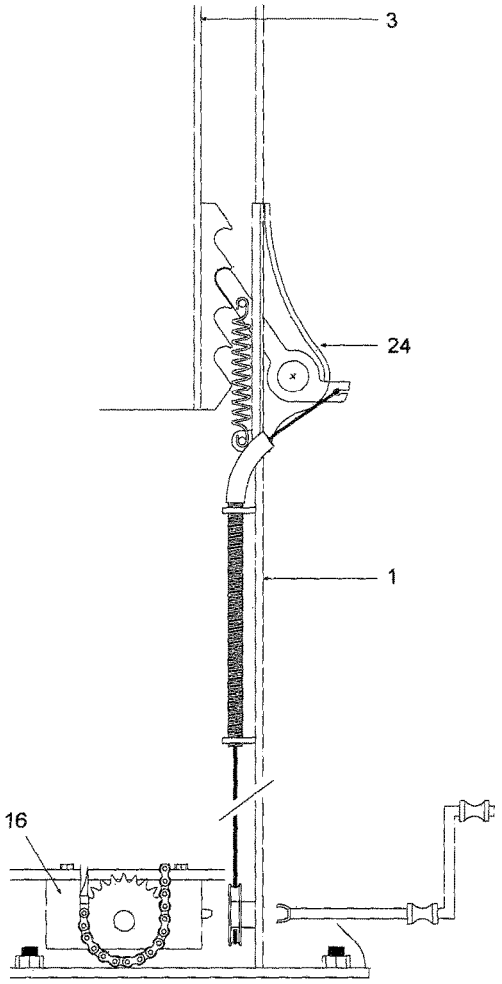

FIG. 16) shows the mechanism used to release the locks (24) that lock tube (1) to tube (3).

Figure 17:
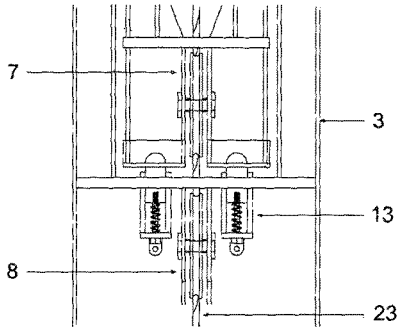

FIGS. 17) and (18) show the locks (13) that hold and fix the spring (26) to the tube (3), as well as the mechanism used to release such locks automatically while lowering the screen (4).

Figure 19:
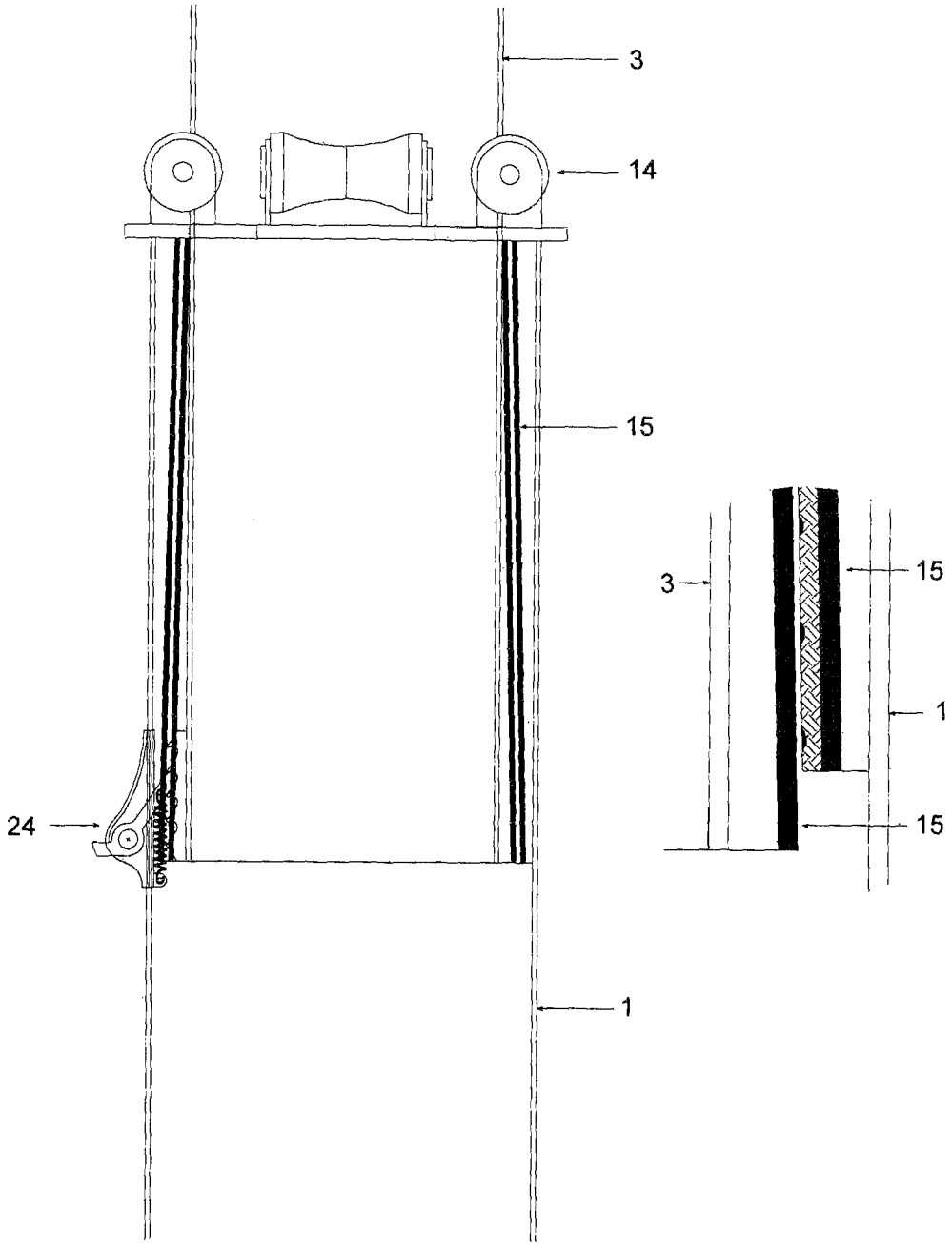

FIG. 19) shows the plates (15) installed on the upper part of the tube (1) and the lower part of the tube (3), which conically assemble and hold both tubes.

Figure 20:
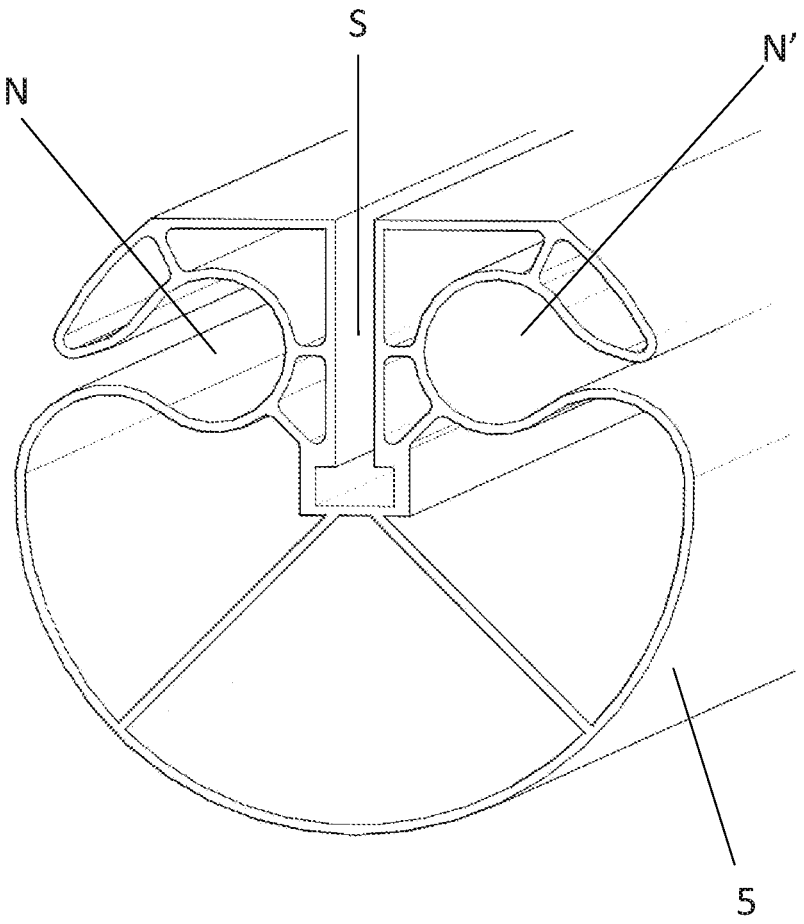

FIG. 20) shows a lateral perspective view of the upper profile (5), showing two notches (N), (N') and a supplementary notch (S).

Figure 21:
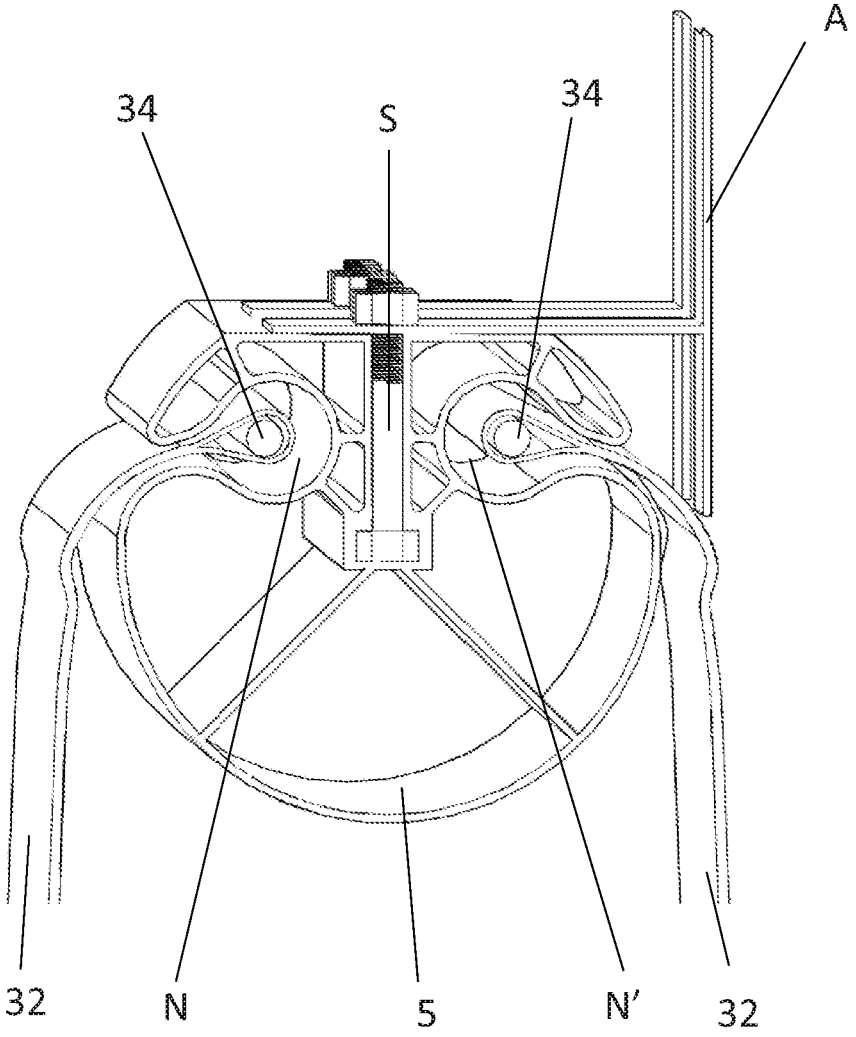

FIG. 21) shows a lateral view of the upper profile (5), showing two notches (N), (N') and a supplementary notch (S) holding additional advertising elements (A).

Figure 22:
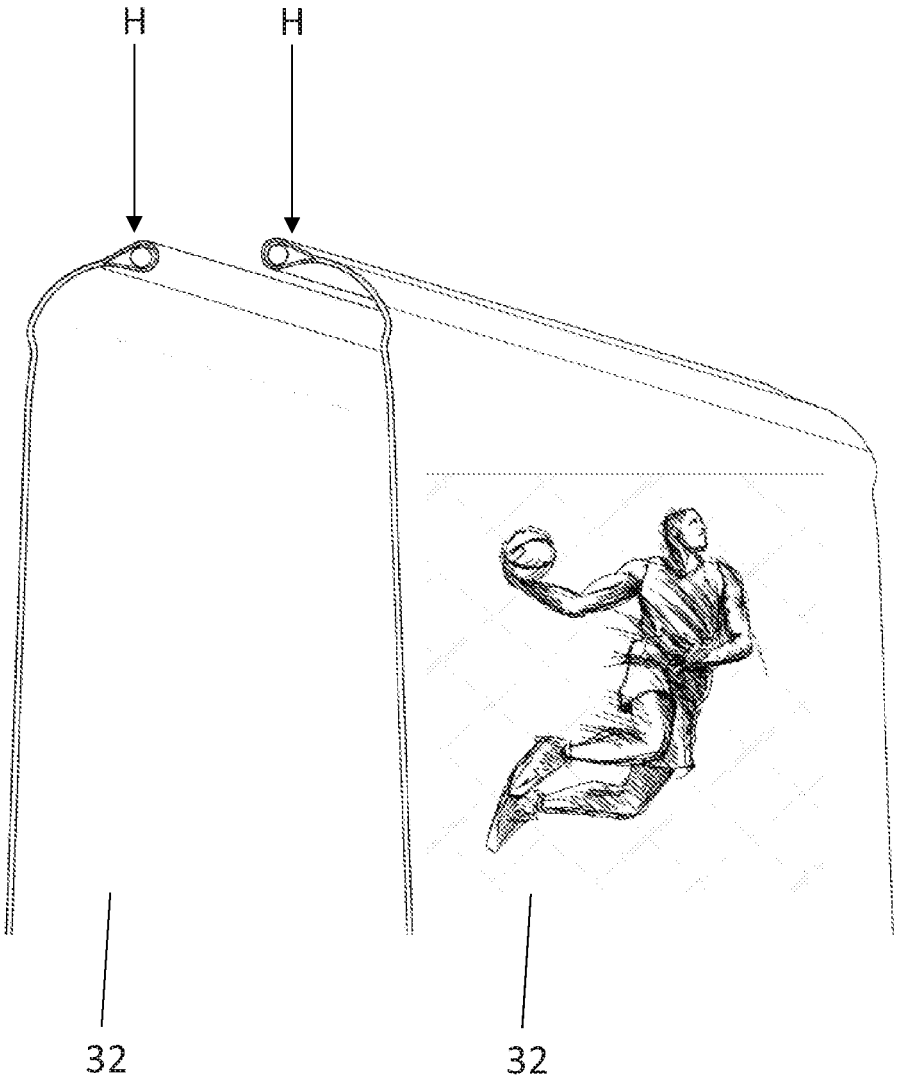

FIG. 22) shows a lateral perspective view of the advertising material (32).

Figure 23:
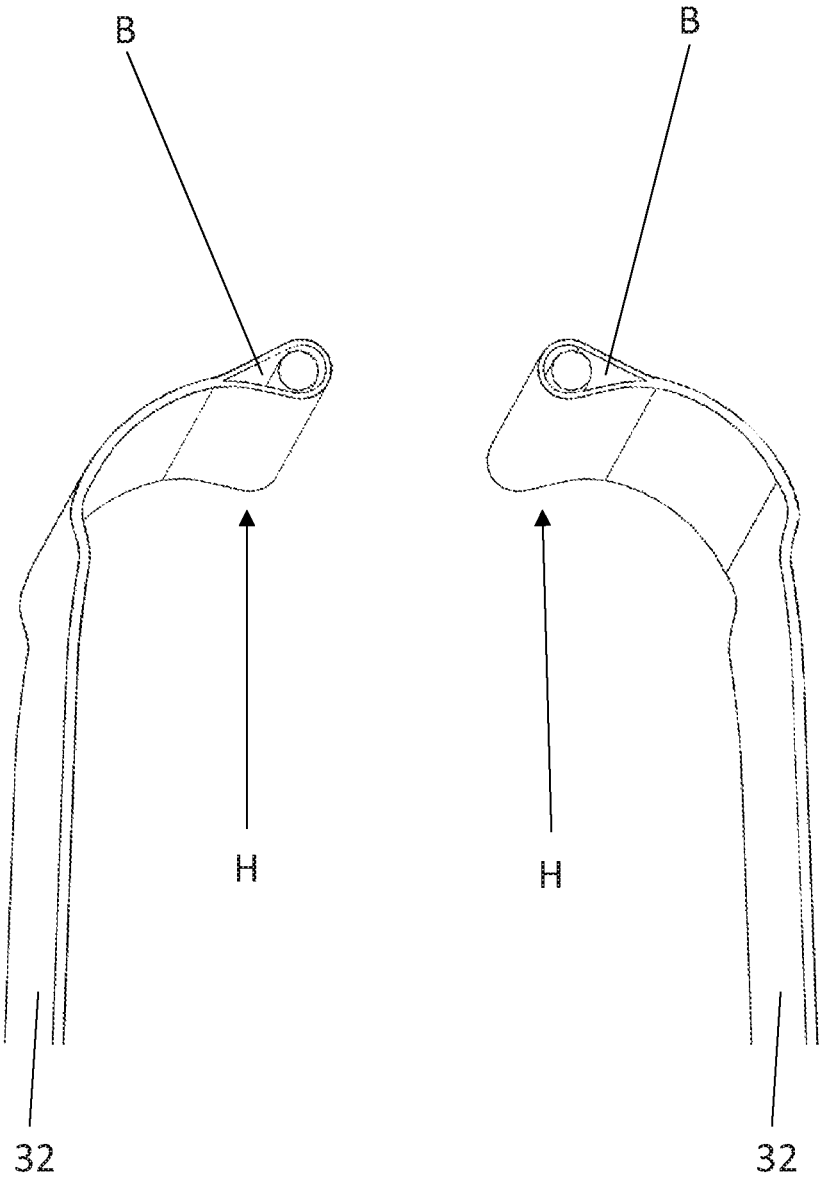

FIG. 23) shows a lateral view of the advertising material (32) showing the hems (H) forming a perimeter bag (B).

DETAILED DESCRIPTION OF THE INVENTION

In general, this invention consists of an outdoor advertising structure (O) with a screen that can be tilted and lowered. Such screen (4), when being struck by the wind, tilts and then goes back to its vertical position, using a mechanism that consists of a counterweight (2) suspended by a wire, preferably made of steel, within the pedestal, formed by tubes (1) and (3) that support the structure.

The flute (9), that is the tube that supports the screen (4), transmits the force of the wind to the inner mechanism of the structure, in this case, the counterweight (2), in order to balance the screen (4), which, in case of strong wind or sudden wind gusts, will stay tilted or in a completely horizontal position, as long as the wind persists.

The mechanism that allows the screen (4) to tilt and then go back to its vertical position, in addition to the counterweight, can include tension springs (28), contraction springs (29), and/or torsion springs (30). It can also use the very weight of the structure through a set of pulleys (see FIG. 5), rods or levers; of a piston or pneumatic device compressing a gas when the screen is tilted (see FIG. 9); or any other device with a retractile function; or a combination of one or more mechanisms such as the ones mentioned above.

When the wind is not so strong or when it is not strong enough, the screen (4) will be vertically aligned, as shown in FIG. 1). While in vertical position, the lifting mechanism, formed by the counterweight (2), exerts enough tension on the wire (23) to keep both sets of pulleys (7 and 8) aligned, one on top of the other. These pulleys allow the wire (23) to work with no friction during times of strong winds and they enable the realignment of the components involved in the tilting of the screen (4), or when the spring (26) is articulated in order to lower the screen (4) and lift it back again.

The advertising material (32), in this case a canvas, or any other material to be tightened, can be fixed to the screen (4) by bending and vulcanizing the hems (H) on each side of the canvas, forming a perimeter bag (B).

The upper side is inserted into a longitudinal notch (N) on the upper profile (5) of the screen (4) (see FIG. 12). Once the bag is inserted into the profile (5) longitudinal notch (N), a rod (34) is inserted along the bag (B), which will be used as a lock and prevent the advertising material (32) from coming out of the notch (N) when applying tension for adjustments (see FIG. 12). FIG. 10) shows how the final adjustment will be performed inside the flute (9) through the rollers (33) anchored to the advertising material (32) with the use of hooks (11); which, in addition to working as lids for one of the edges of the rollers (33), are able to spin through springs (10) which allows the advertising material (32) to roll in order to be tightened. In FIG. 11), the rollers do not have hooks on the edges, but these hooks are added to the springs (10) in order to tighten the advertising material (32). Once the advertising material (32) is rolled on these rollers (33), it will stay tightened even during strong winds, discarding the possibility of vibration shaking the advertising material (32), as the wind cannot enter the space between both sides of the screen (4), extending the useful live and durability of the screen (4) components and the advertising material (32) itself.

The profile (5), according to FIG. 12, shows at least one supplementary notch (S) across its length, which allows the advertiser to hold additional advertising elements (A) in order to make them stand out from the upper edge of the screen (4), making advertisements more versatile and attractive.

In case of wind, using as a solid rod as central axis provided with rotational elements, in this case four rowlocks (17), the screen (4) is tilted by inversely pushing the pendulum (6), which pulls the wire (23), through the ball joint (12) in order to lift the counterweight (2) located inside the tube (1).

Using the very weight of the structure (see FIG. 5); using the energy stored by a pneumatic mechanism, such as a piston (see FIG. 9); or adding tension springs (28), compression springs (29) or torsion springs (30), are some of the mechanisms that allow the screen to tilt and go back to its vertical position (see FIGS. 6, 7 and 8). These mechanisms could help, or even replace the counterweight (2) during this process. The type of mechanism to use will mainly depend on the shape and size of the screen (4); the height of the structure and the weather conditions that predominate in the region where the structure is installed.

When the screen (4) is to be lowered for maintenance, replacement of advertisement or repairs, we must manually carry out the transition from the position in FIG. 2, to the position shown in FIG. 4, using lifting mechanisms such as a motor-reducer (16); a winch (31) according to FIG. 13); or a zipper or serrated rod (34) as the one shown in FIG. 14), which is pushed by the force of a worm drive (35). In this case, the force of a motor-reducer (16) will be used, which is located on the foundation (25) of the structure, inserting and spinning a lever (see FIGS. 15 and 16) through a hole on the lower part of the tube (1). The motor-reducer (16), through a traction element consisting of a serrated wheel (20), transmits the strength on an element that is preferably formed by a section of a chain (19) and a section of a wire (18), just as it is shown in FIGS. 1), (2) and (3). When activating the motor-reducer (16), we can see that the wire (18), by using a pulley (21) installed on the upper part of the tube (1), pushes and slides tube (3) inside tube (1). Both lowering and lifting tube (3) are performed through rods (14) located on the upper part of tube (1), protecting the surface of the tube (3) from any friction that may damage the finishing.

It is worth mentioning that the lever shown in FIG. 15) is provided with a die whose inner part is different from the common dies used to adjust nuts or screws, in order to prevent unauthorized people from tampering the operation of the structure.

While the screen is being lowered, the tilting mechanism, formed by the counterweight (2), will enter into contact with the plate that holds the motor-reducer (16) and it will lean on such plate at the lower part of tube (1), which will cause the screen (4) to tilt and rotate on its axis. After rotating 180 degrees, the screen (4) will be in a vertical position on one side of tube (1), as shown in FIG. 4.

The procedure to change the screen (4) would not be possible if the locks (24) are not released from the lower part of the structure; such locks lock tube (1) to tube (3). In order to do this, we insert and rotate the lever, as shown in FIG. 16. Likewise, before tube (3) is lowered, the locks (13) holding the spring (26) fixing it to tube (3) must be released.

Figure 18:
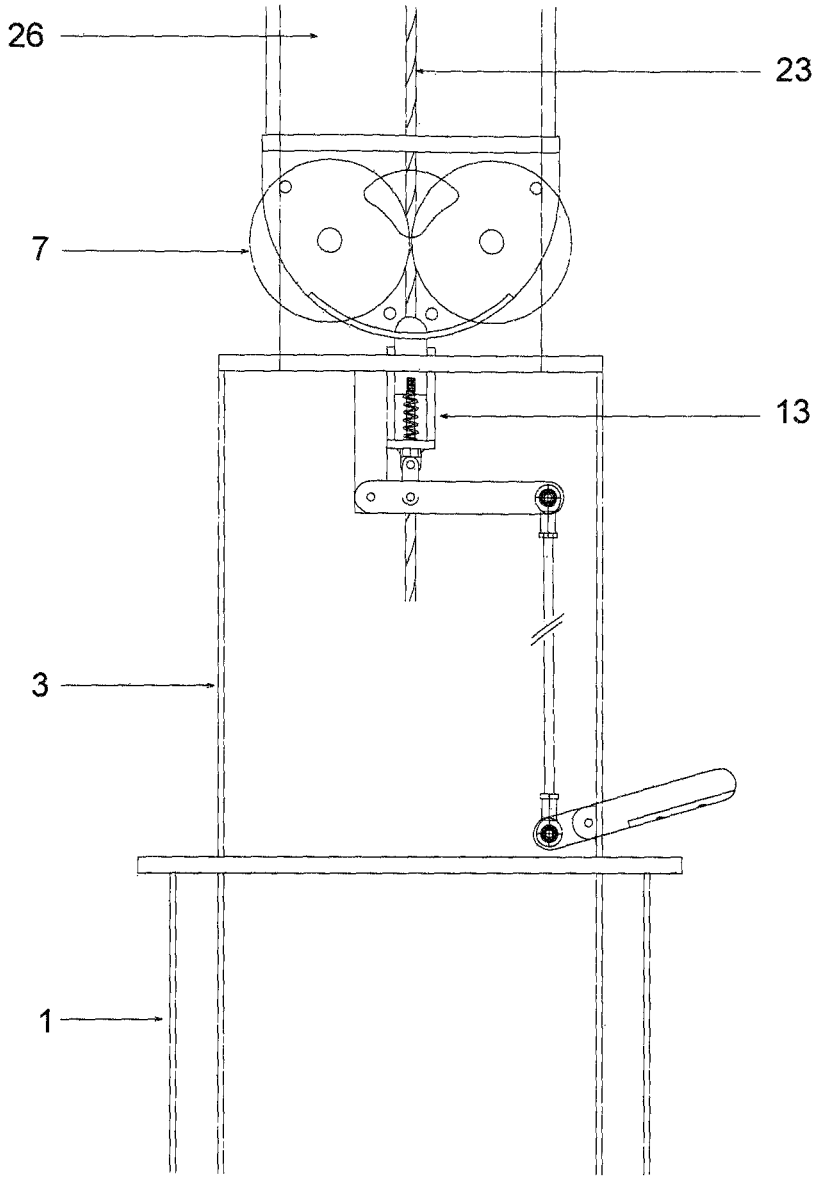

This can be done manually or automatically while the tube is being lowered, using the mechanism shown in FIG. 18.

It is worth mentioning that the bolts (22) will work as axis for the spring (26) to rotate and cause a misalignment in axis (17) from its initial position, allowing the screen (4) to align vertically and in parallel to the tube (1), while descending, as shown in FIG. 4.

Once maintenance and/or the replacement of the advertisement have been performed, we must take the screen (4) back to its original vertical position. In order to do this, we must insert the lever (see FIG. 15) into the motor-reducer (16) and make it spin until tube (3) ascends and is conically assembled through the plates (1) installed on both the upper part of tube (1) and the lower part of tube (3), as shown in FIG. 19. At least four plates welded to the outer part of the tube (3), go up until reaching the same number of welded plates on the outer part of tube (1), these plates have a plastic cover to separate the plates, preventing them from damages caused by being in contact for large periods of time. The plates (15), along with the locks (24), achieve a perfect fastening of the tube with the smaller diameter (3) and the tube with the bigger diameter (1), preventing movements that can cause wear or malfunctions in the structure.

The invention claimed is:

1. Outdoor billboard that can be tilted and lowered, and does not put up resistance to the wind, comprising:

a pedestal comprising:

a first hollow tube having a base;

a second hollow tube having a lower end and an upper end and having a smaller diameter that the first hollow tube, said second hollow tube being slidable inside the first hollow tube so that the second tube can be lowered and lifted;

means for lowering the second hollow tube inside the first hollow tube and for lifting the second hollow tube out of the first hollow tube, said means comprising a mechanism including a moto-reducer employing sprockets and chains holding the second hollow tube;

a screen having:

a front and a rear surface;

an upper end having an upper profile having two notches along its length and at least one supplementary notch across its length, which allows to hold additional advertising elements in order to make them stand out from the upper edge of the screen;

a lower end;

an advertising material placed on a surface of the screen, having a perimeter hem forming a perimeter bag having an upper portion and a lower portion wherein the upper portion and the lower portion are inserted on a notch of a corresponding profile;

a rod, inserted along the upper portion of the perimeter bag and supported by a notch of the upper profile, for preventing the advertising material from coming out of the notch;

wherein the lower end of the screen having a tension mechanism to keep advertising material in constant tension over the front or rear surface of the screen;

wherein the lower end of the screen is pivotally connected to the upper end of the second hollow tube; and a tilting mechanism, allowing the screen to pivot and tilt over the upper end of the second hollow tube according to the force of the wind and returning to a vertical position, said tilting mechanism comprising a counterweight suspended from a steel wire connected to the lower end of the screen and located inside the first hollow tube and second hollow tube, said counter-weight exerting a constant downward force on the lower end of the screen, and wherein the steel wire exits the second hollow tube trough the upper end to be connected to the lower end of the screen.

2. Outdoor billboard according to claim 1 wherein the tension mechanism to keep advertising material in constant tension comprising a flute located along the lower end of the screen, said flute having a hollow interior including a pair of rollers attached therein, each roller being inserted in the lower portion of a perimeter bag of an advertising material, each roller having hooks attached to their edges to hook the lower portion of the advertising material and each roller being driven by a spring, each spring having a first and a second end, wherein the first end of each spring is attached to an inner wall of the flute, and the second end of each spring is attached to an edge of the roller, so that each spring exerts a force on a correspondent roller thus pulling the anchor which in turn rolls and pulls the advertising material towards the inside of the flute to keep it constantly and evenly tightened.

3. Outdoor billboard according to claim 1, wherein the means for lowering the second hollow tube inside the first hollow tube and for lifting the second hollow tube out of the first hollow tube comprising:

a motor-reducer located on the base of the first hollow tube, driven by a spinning a lever inserted through a hole on the lower portion of the first hollow tube, said motor-reducer transmitting its force through a traction element consisting of a serrated wheel on an element that is preferably formed by a section of a chain and a section of a wire, which by using a pulley installed on the upper part of the first hollow tube, pushes and slides the second hollow tube inside the first hollow tube, wherein the second hollow tube slides into and out the first hollow tube by contacting rods located on the upper part of the first hollow tube for protecting the surface of the second hollow tube from any friction that may damage the finishing.

4. Outdoor billboard according to claim 1, wherein the tilting mechanism further comprising two sets of pulleys located at the upper end of the second hollow tube, wherein the steel wire passes between the set of pulleys, thus allowing the steel wire to work with no friction during times of strong winds.

5. Outdoor billboard according to claim 1, wherein the tension mechanism to keep advertising material in constant tension comprising a flute located along the lower end of the screen, said flute having a hollow interior including a pair of rollers attached therein, each roller being inserted in the lower portion of a perimeter bag of an advertising material, and each roller being driven by a spring, each spring having a first and a second end, wherein the first end of each spring is attached to an inner wall of the flute, and the second end of each spring has a hook to hook the lower portion of the advertising material, so that each spring pulls the lower portion of the advertising material towards the inside of the flute guided by a correspondent roller to keep it constantly and evenly tightened.

6. Outdoor billboard according to claim 1, wherein the lower end of the screen is attached to a pendulum pivoting over a shaft.

* * * * *